US008584329B2

(12) United States Patent
Dhakka

(10) Patent No.: US 8,584,329 B2
(45) Date of Patent: Nov. 19, 2013

(54) JEWELRY SETTING AND PROCESS FOR SETTING PRECIOUS STONES

(76) Inventor: Sachin Chandulal Dhakka, Mumbai (IN)

( * ) Notice: Subject to any disclaimer, the term of this patent is extended or adjusted under 35 U.S.C. 154(b) by 389 days.

(21) Appl. No.: 12/656,439

(22) Filed: Jan. 29, 2010

(65) Prior Publication Data

US 2011/0126586 A1 Jun. 2, 2011

(30) Foreign Application Priority Data

Dec. 1, 2009 (IN) ..... 2774/MUM/2009

(51) Int. Cl.
*B23P 5/00* (2006.01)

(52) U.S. Cl.
USPC ..... 29/10; 29/8; 29/896.4; 29/896.412; 63/15; 63/26; 63/27; 63/28; 63/32; D11/91

(58) Field of Classification Search
USPC ..... 29/10, 8, 896.4, 896.412; 63/15, 26, 27, 63/28, 32; D11/91
See application file for complete search history.

(56) References Cited

U.S. PATENT DOCUMENTS

| | | | | |
|---|---|---|---|---|
| 4,222,245 | A | | 9/1980 | Vitau |
| 4,819,453 | A | | 4/1989 | McNamara |
| 5,357,770 | A | | 10/1994 | Lanyi |
| 5,377,506 | A | * | 1/1995 | Tranzer ..... 63/28 |
| 5,431,028 | A | | 7/1995 | Lampert et al. |
| 5,432,988 | A | | 7/1995 | Woo |
| 5,533,364 | A | | 7/1996 | Freilich |
| 6,260,384 | B1 | | 7/2001 | Mino et al. |
| 6,318,121 | B1 | | 11/2001 | Pachauer |
| 6,378,335 | B1 | | 4/2002 | Siebenberg |
| 6,401,489 | B1 | | 6/2002 | Cheng |
| 6,453,701 | B1 | | 9/2002 | Katz |
| 6,550,275 | B2 | | 4/2003 | Steinberg |
| 6,578,380 | B1 | | 6/2003 | Pluchenik |
| 6,591,633 | B2 | | 7/2003 | Pachauer |
| 6,615,611 | B1 | | 9/2003 | Schachter et al. |
| D480,659 | S | | 10/2003 | Pachauer |
| 6,634,184 | B2 | | 10/2003 | Feldman |
| 6,698,239 | B2 | | 3/2004 | Wueste |
| 6,913,009 | B2 | | 7/2005 | Shuto |
| 6,915,663 | B2 | | 7/2005 | Shuto |

(Continued)

*Primary Examiner* — Peter DungBa Vo
*Assistant Examiner* — Azm Parvez
(74) *Attorney, Agent, or Firm* — Gottlieb, Rackman & Reisman PC

(57) ABSTRACT

The present invention relates to a method of setting stones, preferably precious stones like diamonds, in a mounting comprising (a) setting a base metal having a floor with a central cavity; (b) placing a center stone as a first layer of stone, the center stone having a pavilion, a girdle and a crown, such that the pavilion is placed inside the above stated cavity, the girdle inserted in incisions in the peripheral walls of the base metal from the side; (c) placing each of the respective layers of stones adjacent and marginally above each other, each stone having a pavilion, girdle and crown such that the pavilion of each of the respective stones is placed in its respective cavity, the girdle of each stone being inserted in the incisions in the peripheral walls; such that the peripheral walls of each of the layer forms the base of the cavity of the next layer; stones in each of the layers are held only from one side by said peripheral wall; the stones of following layer marginally overlap the crown of the stones at the previous layer to hide the metal wall holding said girdle of the stones; and such that the stones in adjacent layers do not touch each other.

17 Claims, 7 Drawing Sheets

(56) References Cited

U.S. PATENT DOCUMENTS

| | | | |
|---|---|---|---|
| 7,444,835 | B2 | 11/2008 | Mehta |
| 7,461,452 | B1 | 12/2008 | Kothari |
| 7,546,749 | B1 | 6/2009 | Biren |
| 7,762,104 | B2 | 7/2010 | Lin |
| 8,051,676 | B2 | 11/2011 | Lin |
| 2009/0056376 | A1 | 3/2009 | Lin |
| 2010/0229598 | A1 | 9/2010 | Lin |

* cited by examiner

JEWELRY SETTING AND PROCESS FOR SETTING PRECIOUS STONES

TECHNICAL FIELD

The present invention relates to a process for setting stones. Particularly, the present invention relates to a process for setting stones, especially precious stones such as diamonds, into a unique setting to make it visibly more attractive.

BACKGROUND OF THE INVENTION

There are many kinds of setting techniques prevalent in the industry for decades. The basic idea of all kinds of settings is to hold the precious stones like diamonds with minimum metal so as to expose the stone or the diamond to maximum light, thereby making it visibly more attractive. The intent is to give the jewelry a bold and bigger look by creating an illusion of a single large diamond at a fraction of the cost of a solitaire diamond.

One such setting is the pressure setting wherein the centre round shaped stone is held in place by the surrounding 6 (six) stones in a circular pattern, and overlapping it. The centre stone is secured in place with the pressure applied from these stones. There is limitation in the look achieved which entirely depends on the sizes of the diamonds used. The bigger the size of the diamonds used, the higher is the perceived price. The maximum number of diamonds used in such kinds of settings is 13 (thirteen). The above technique is limited to a two layered setting pattern if the centre stone is considered as the first layer.

A similar alternate setting places the centre stone below 4 (four) equally sized round shaped stones in a square formation. The centre stone sits on the rim of the metal below. The centre stone does not depend upon the upper stones for being secured. The limitations are again similar to the first instance of setting.

U.S. Pat. No. 7,546,749 (Biren Richard Warren) describes an article of jewelry that supports a plurality of primary stones in a linear mounting array which is bordered on both sides by accent stones. The girdles of the primary stones and of the accent stones are positioned close to each other with the accent stone girdles being above the primary stone girdles. The patent disclosed a method of making the article of jewelry which includes the use of a lost wax casting process followed by hand-setting of the accent stones and an application of a highly reflective coating, such as rhodium to surfaces that are adjacent the areas of congruence of the primary and accent stones. The resultant piece of jewelry presents the appearance of floating or unsupported primary stones.

U.S. Pat. No. 7,461,452 (Fine Jewellery (India) Ltd.) discloses a center stone held by small prongs, an outer series of stones wherein each outer stone is held by a pair of large prongs, and an intermediate series of stones held by the larger outer prongs which hold the small stones so that the intermediate stones partially cover the centre stone and outer series of stones in a manner which conceals the way the outer stones are held.

The above techniques are limited to a two layered setting pattern if the centre stone(s) are (is) considered as the first layer. The look achieved by the above patents entirely depends on the sizes of the diamonds used. The bigger the size of the diamonds used, the higher is the perceived price.

The need is to improve upon the setting techniques wherein smaller sized stones (but more in number) can be used to give a much bigger illusion at a much lesser price, thereby adding infinite number of layers.

OBJECT OF THE INVENTION

It is the object of the present invention to improve upon the prior techniques and provide a process for setting precious stones in a way as to give a much bigger solitaire diamond effect and make it visibly more attractive.

SUMMARY OF THE INVENTION

The present invention relates to a method of setting stones, preferably precious stones, in a mounting comprising (a) setting a base metal having a floor with a central cavity; (b) placing a center stone as a first layer of stone, the center stone having a pavilion, a girdle and a crown, such that the pavilion is placed inside the above stated cavity, the girdle inserted in incisions in the peripheral walls of the base metal from the side; (c) placing each of the respective layers of stones adjacent and marginally above each other, each stone having a pavilion, girdle and crown such that the pavilion of each of the respective stones is placed in its respective cavity, the girdle of each stone being inserted in the incisions in the peripheral walls; such that the peripheral walls of each of the layer forms the base of the cavity of the next layer; stones in each of the layers are held only from one side by said peripheral wall; the stones of following layer marginally overlap the crown of the stones at the previous layer to hide the metal wall holding said girdle of the stones; and such that the stones in adjacent layers do not touch each other. The present invention has been described with reference to diamonds as precious stones.

DESCRIPTION OF THE INVENTION

A preferred embodiment of the present invention will now be described with reference to the figures accompanying the specification wherein.

Figure 1:
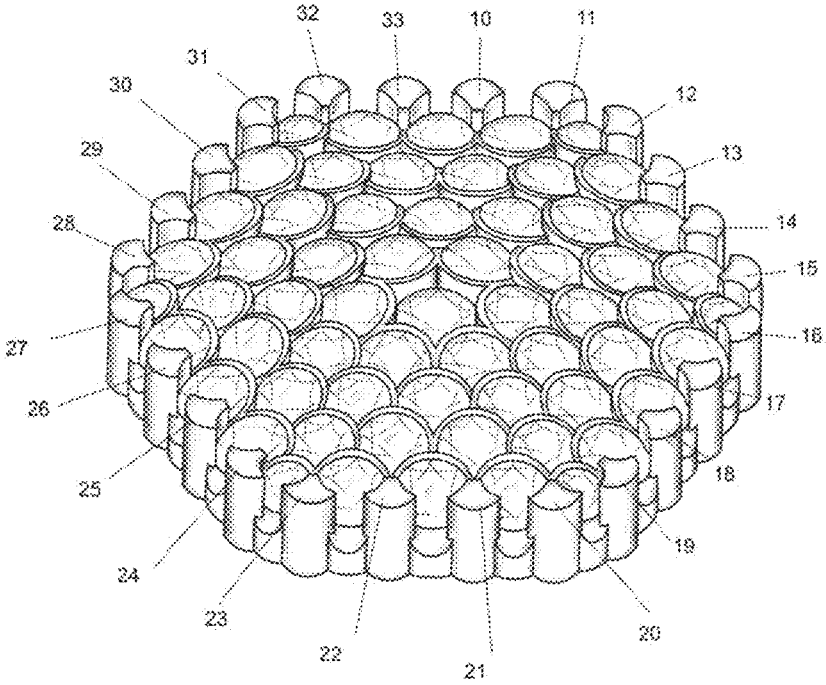
FIG. 1 shows the perspective view of the mounting where all the diamonds are set in their respective slots.
Figure 2:
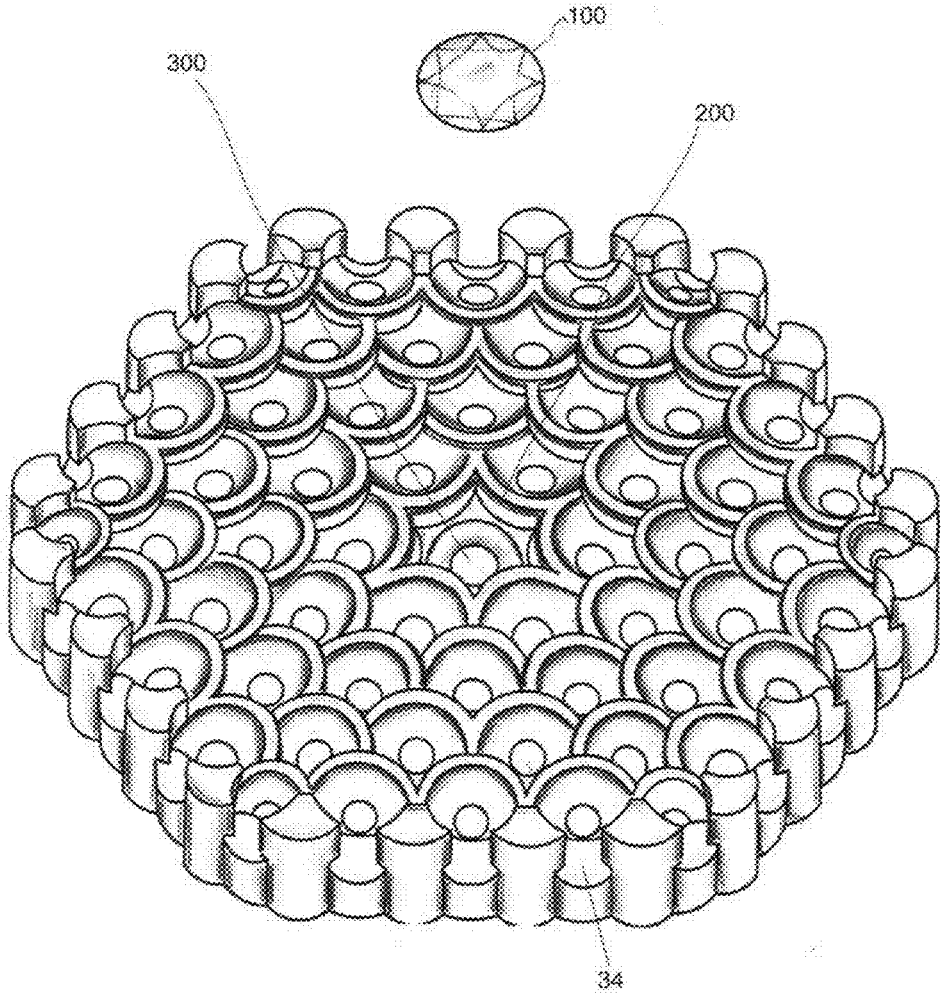
FIG. 2 shows the perspective view of the mounting with the centre stone raised above to show the cavity where it would rest.
Figure 3:
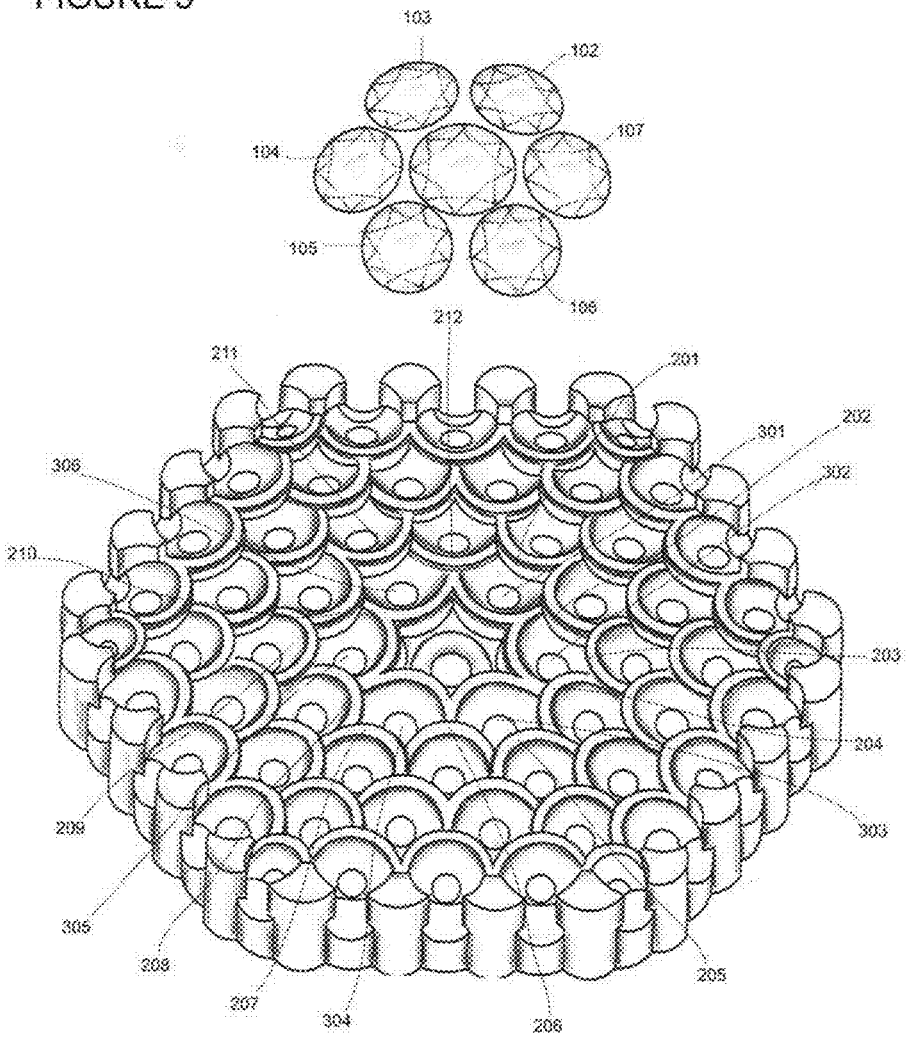
FIG. 3 illustrates the perspective view of the mounting where the centre diamond which acts as layer one and surrounding six diamonds which acts as the $2^{nd}$ layer.
Figure 4:
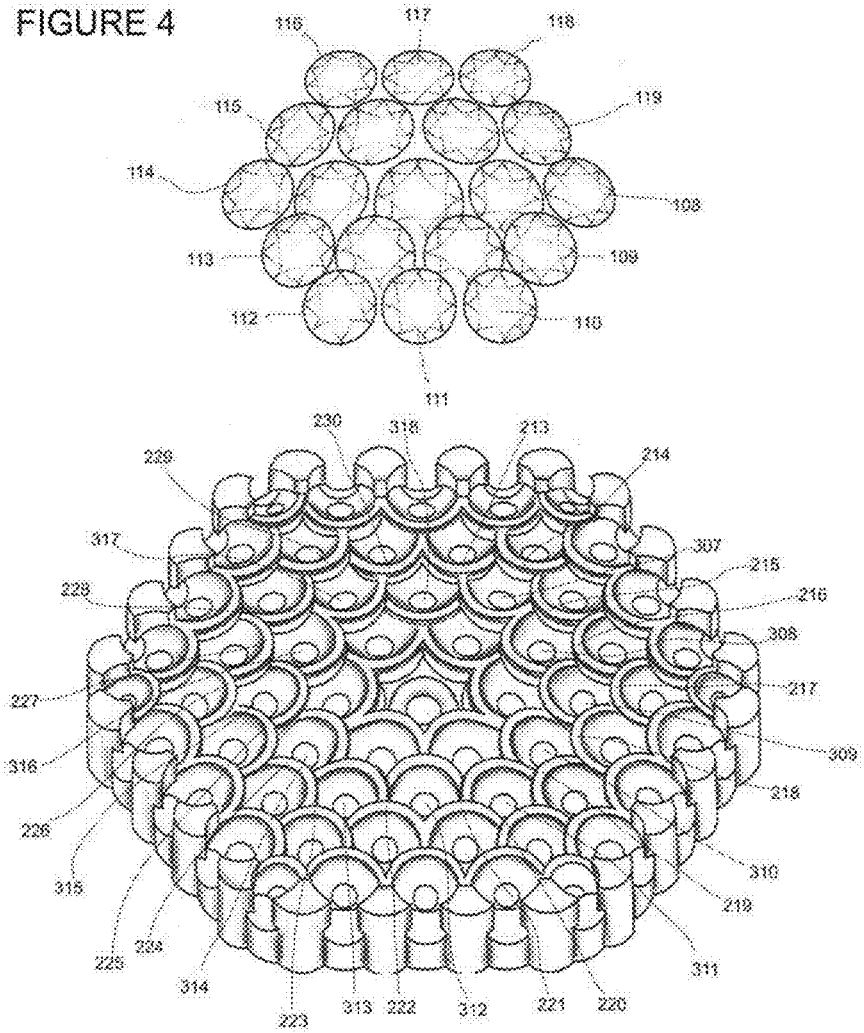
FIG. 4 shows the perspective view of the mounting where the $3^{rd}$ layer of 12 diamonds is shown along with the other 2 layers.
Figure 5:
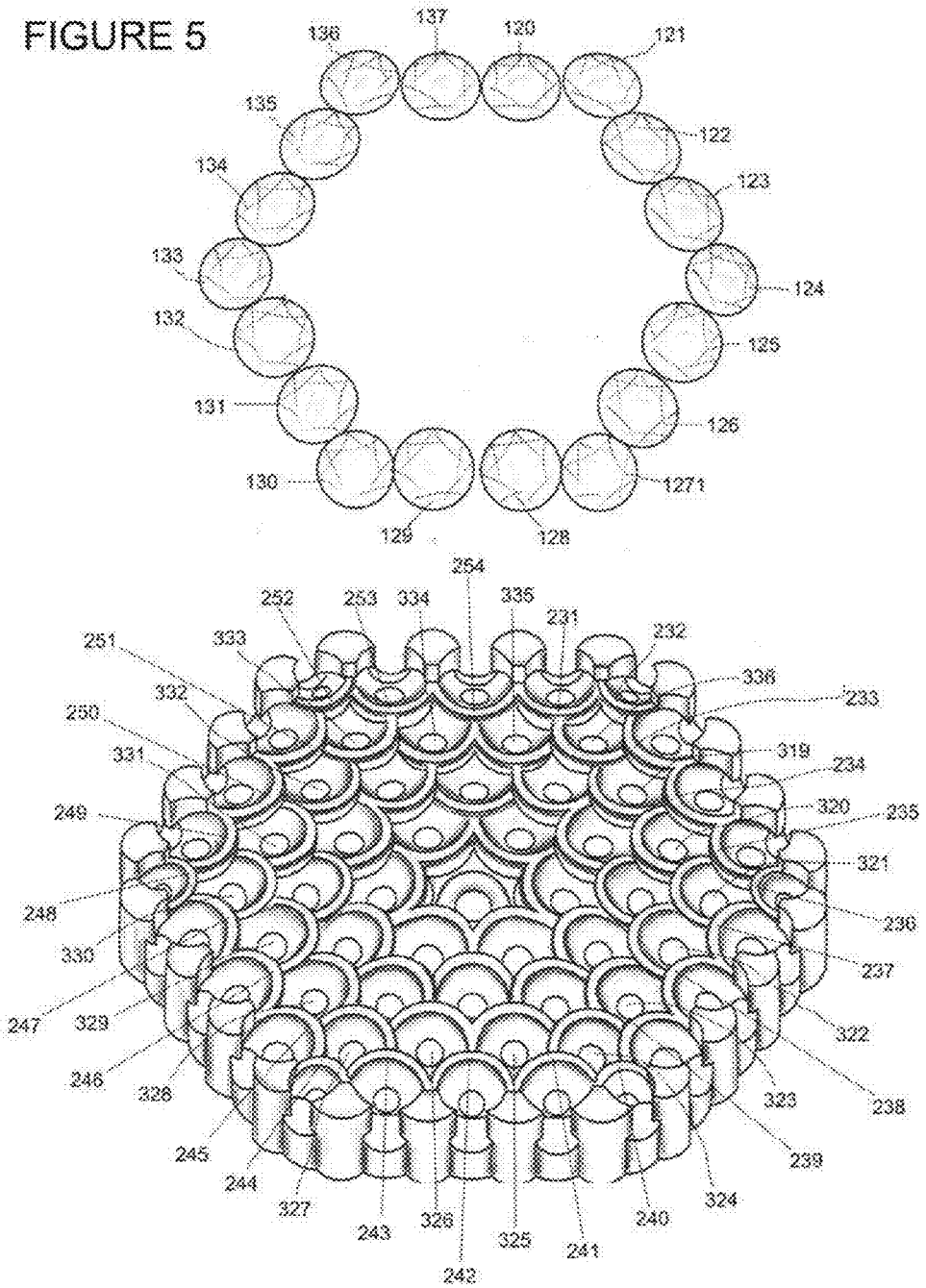
FIG. 5 shows the perspective view of the mounting where the 3 layers of diamonds are set and a $4^{th}$ layer of 18 diamonds is shown along with the slot where the diamonds are supposed to be placed and set in the peripheral walls.
Figure 6:
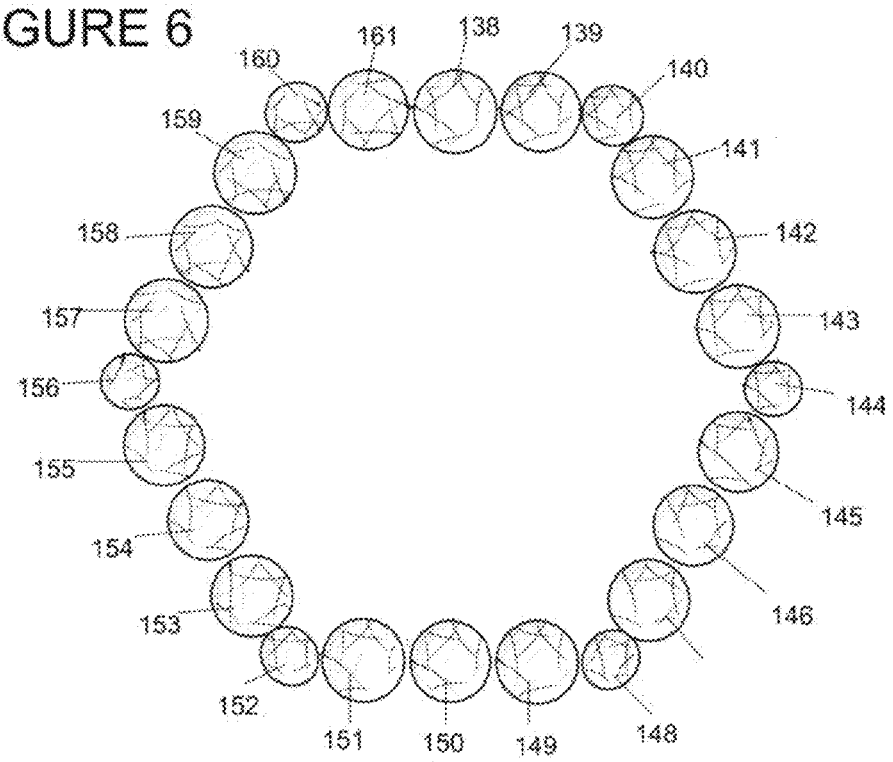
FIG. 6 illustrates the perspective view of the mounting where the 4 layers of diamonds are set and a $5^{th}$ layer of 24 diamonds is shown along with the slot where the diamonds are supposed to be placed and set in the peripheral prongs.
Figure 6:
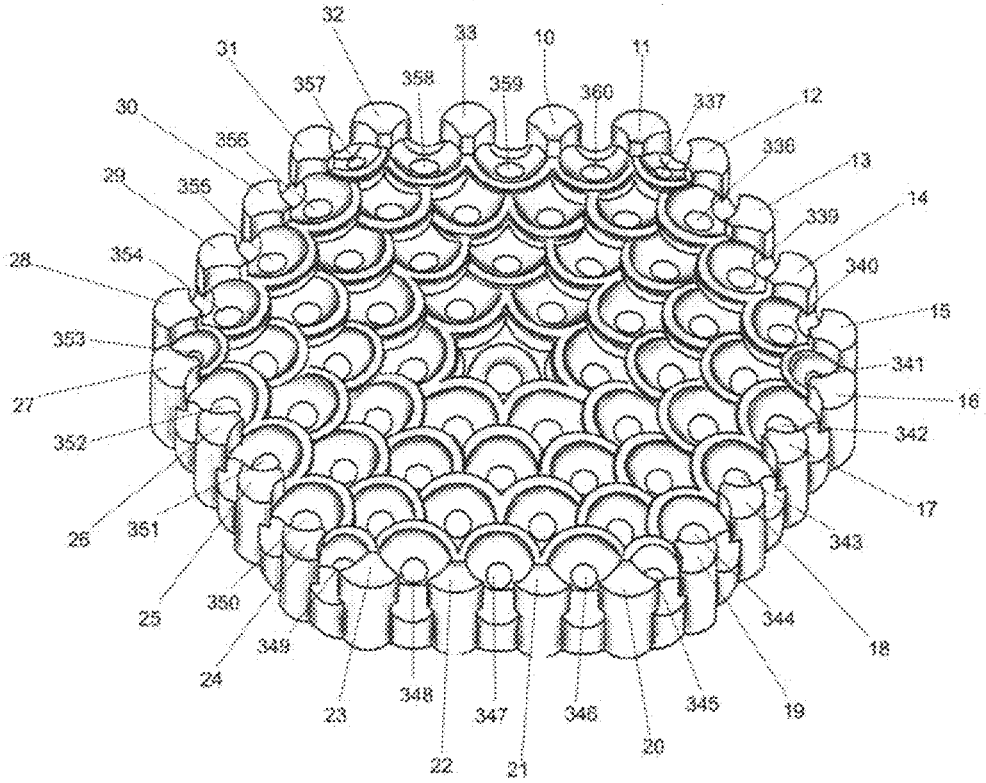
Figure 7:
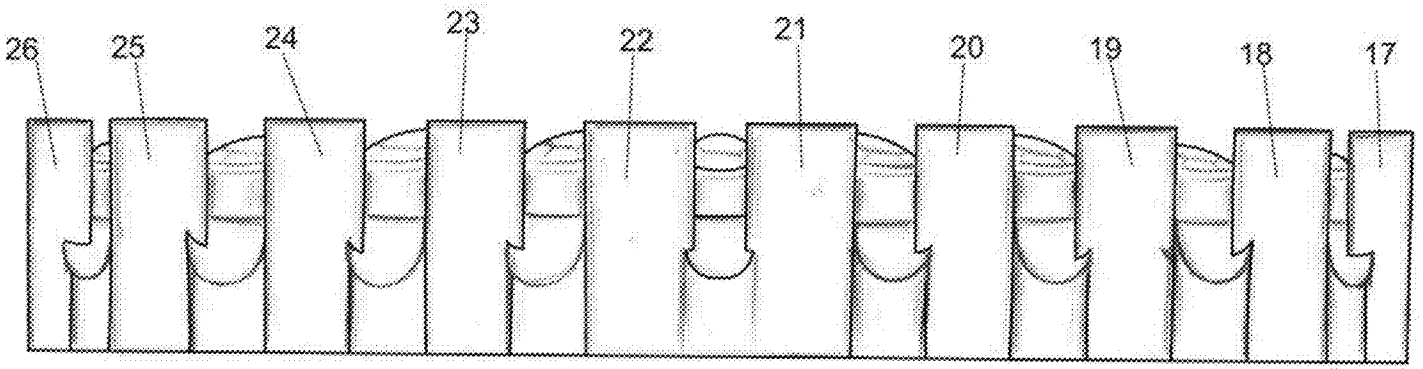
FIG. 7 shows the front plan view of the mounting which shows the prongs in the periphery of the mounting.

Referring to the figures, the stones are set in a multi layered pattern in an incremental and rotational manner starting from a lower point and rising above. Each figure described above shows the process in an incremental setting format. Stones in adjacent layers (above and below) are not touching each other.

The center stone, as a first layer of stone, is placed in a central cavity formed by the base metal with a floor. This center stone is having a pavilion, a girdle and a crown, such that the pavilion is placed inside the above stated cavity, the girdle inserted in incisions in the peripheral walls of the base metal from the side. Thereafter each of the respective layers of stones are placed adjacent and marginally above each other, each stone having a pavilion, girdle and crown such that the pavilion of each of the respective stones is placed in its respective cavity, and the girdle of each stone is inserted in the incisions in the peripheral walls; such that the peripheral walls of each of the layer forms the base of the cavity of the next layer; and stones in each of the said layers are held only from one side by said peripheral wall. The stones of each of the following layer marginally overlap the crown of the stones at the previous layer to hide the metal wall holding the girdle of the stones. Further, the stones in adjacent layers do not touch each other.

The technique has a base metal having a floor (34) with a central cavity. A mounting with the centre stone (100) placed in a cavity (300) which has surrounding metal walls (200) where the diamonds are incised and secured is set. A preferred embodiment of the invention has been described using stones set up to 5 layers where the centre stone (100) is counted as the first layer. The stone is set and held firmly in the peripheral walls (200) of the base metal. These walls also act as the base of the metal cavities (300) formed adjacent and above the centre stone in a step pattern in a rotational manner. A 2nd layer of stones (102-107) is placed into the cavities (301-306). The centre stone (100) is slightly overlapped by the stones (102-107) which are set above it into these metal cavities (301-306).

The difference of the setting disclosed in the present invention with the prior art is that stones in the adjacent layers (above and below) disclosed in the present setting do not touch each other when they are overlapping. The stones are set in the peripheral walls. The overlapping of diamonds is done to hide the walls from visibility.

The 2nd layer stones (102-107) are set and held firm in the peripheral walls (201-212) surrounding them. These walls (201 212) also act as the base of the cavities (307-318) formed in the 3rd layer. Stones (108-119) are placed into this 3rd layer cavities (307 318) and set into the peripheral walls (213-230) surrounding it. These walls (213-230) also act as the base of the cavities (319-336) in the 4th layer. Stones (120-137) are placed into this 4th layer and set into the surround walls (231-254). Again these walls act as the base of the cavities (337-360) in the 5th layer. Stones (138-161) are placed into this 5th layer cavities and set into the peripheral prongs (10-33) surrounding them. Additional layers can be added as per the desire of the customers using the above method. The last layer thereby is set into a series of prongs placed in a rotational manner. Layer after layer of collets are raised where the stones keep increasing as the diameter or the area expands going upwards and around. All stones are set in the wall of the collets holding diamonds higher up. The various forms and shapes made using this technique are hexagonal round, square, marquee, pear, oval, cushion and heart. All other kinds of shapes and forms, geometric and non-geometric, are covered in the scope of this technique.

The setting using the above technique is very compact, leaving no visible negative space between the stones. The sizes of each stone vary as per spaces available geometrically. Further, the placement of the stones is synchronous with the height, thickness, width and diameter of the metal collets. If the stones are seen from the top view, as depicted in FIG. 1, no metal is visible between the stones—only the metal prongs in the periphery surrounding the last layer are visible. Without any visible metal, it appears as a single large diamond. The stones of the upper layers excluding the centre stone are held very finely from one side which is again hidden from view. The other side of the stone is only supported by the metal collets lying below it giving it an appearance of floating in the air. The intention is to elaborate the look with multiple layers of diamonds merging into each other seamlessly.

Although the invention has been described in terms of particular embodiments and applications, one of ordinary skill in the art, in light of this teaching, can generate additional embodiments and modifications without departing from the spirit of or exceeding the scope of the claimed invention. It should be emphasized that the above-described embodiments of the present invention, particularly any "preferred" embodiments, are merely possible examples of the invention of implementations, merely set forth for a clear understanding of the principles of the invention. Accordingly, it is to be understood that the drawings and descriptions herein are proffered by way of example to facilitate comprehension of the invention and should not be construed to limit the scope thereof.

The invention claimed is:

1. A method of setting a plurality of stones in a jewelry setting, each stone having a pavillion, a girdle and a crown, comprising the steps of:

providing said jewelry setting, wherein said jewelry setting is formed of (a) a base metal with a central cavity surrounded by a base peripheral wall of a uniform height, said central cavity defining a first layer;

(b) a first plurality of retaining cavities partially elevated relative to said central cavity, surrounding said central cavity and defining a second layer, wherein each of said first plurality of retaining cavities are individually defined at the front portion thereof by said base peripheral wall;

(c) a second plurality of retaining cavities surrounding said first plurality of retaining cavities and defining a third layer, wherein each of said second plurality of retaining cavities are individually defined at the front portion thereof by first layer peripheral walls positioned at the rear of said first plurality of retaining cavities;

(d) incisions in said first layer peripheral walls, said incisions positioned in said first layer peripheral walls to retain the girdle of a stone;

securing one of said plurality of stones in said base cavity of said jewelry setting and securing the remaining stones in said first plurality of retaining cavities and in said second plurality of retaining cavities;

wherein when said plurality of stones are set in said central cavity and said retaining cavities, the stones set in a layer other than the first layer marginally overlap stones set in the preceding layer.

2. The method of claim 1, wherein said second plurality of retaining cavities has a greater number of retaining cavities than said first plurality of retaining cavities.

3. The method of claim 1, wherein said incisions are positioned such that said incisions do not contact the portion of the girdle of the stone facing the center of said setting.

4. The method of claim 1, wherein said first layer, said second layer and said third layer are positioned relative to one another to prevent stones in a given layer from directly contacting stones in another layer.

5. The method of claim 1, wherein when stones are set, said peripheral walls are concealed from view.

6. The method of claim 1, wherein when stones are set, overlapping stones conceal said peripheral walls from view.

7. The method of claim 6, wherein when stones are set, said incisions retaining overlapped stones are concealed by said overlapping stones from view.

8. The method of claim 1, wherein when stones are set, there is no visible negative space between stones.

9. The method of claim 1, further comprising metal prongs positioned at the edge of said setting, wherein when stones are set, said prongs are constructed to retain stones set in an outermost layer of said setting.

10. A method of setting a plurality of stones in a jewelry setting, each stone having a pavillion, a girdle and a crown, comprising the steps of:

providing said jewelry setting, wherein said jewelry setting is formed of (a) a base metal with a central cavity forming a base layer;

(b) a plurality of bordering cavities sized to retain stones, said plurality of bordering cavities arranged in a layered configuration and forming a plurality of adjacent layers surrounding said central cavity, wherein one of said plurality of adjacent layers forms an outer layer; and (c) a plurality of peripheral walls with incisions at each adjacent layer, wherein said peripheral walls at a given adjacent layer form the bordering cavities of a succeeding adjacent layer;

securing one of said plurality of stones in said central cavity and remaining stones of said plurality of stones in said bordering cavities;

wherein when said plurality of stones are set in said central cavity and said bordering cavities, the stones set in an adjacent layer marginally overlap stones set in a preceding layer, concealing said peripheral walls of the preceding layer; and further wherein overlapping portions of overlapping stones are not retained in said incisions of said peripheral walls.

11. The method of claim 10, wherein said each successive adjacent layer comprises a greater number of retaining cavities than the preceding adjacent layer.

12. The method of claim 10, wherein said incisions are positioned so as not to contact the portion of the girdle of the stone facing the center of said setting.

13. The method of claim 10, wherein said base layer and said adjacent layers are positioned relative to one another to prevent stones in a given layer from directly contacting stones in another layer.

14. The method of claim 10, wherein when stones are set, overlapping stones conceal said peripheral walls from view.

15. The method of claim 10, wherein when stones are set, there is no visible negative space between stones.

16. The method of claim 10, further comprising metal prongs positioned at the edge of said setting, wherein when stones are set, said prongs are constructed to retain stones set at said outer layer of said setting.

17. The method of claim 10, wherein when stones are set, said stones in two adjacent layers appear to contact one another and are separated from contact by said peripheral walls positioned between said two adjacent layers.

* * * * *